US007865987B2

(12) United States Patent
Deetsch

(10) Patent No.: US 7,865,987 B2
(45) Date of Patent: Jan. 11, 2011

(54) HEAD POSITIONING APPARATUS

(75) Inventor: Todd Douglas Deetsch, Louisville, KY (US)

(73) Assignee: Neck Guard Industries, LLC, Louisville, KY (US)

( * ) Notice: Subject to any disclaimer, the term of this patent is extended or adjusted under 35 U.S.C. 154(b) by 0 days.

(21) Appl. No.: 11/799,698

(22) Filed: May 2, 2007

(65) Prior Publication Data

US 2008/0271249 A1 Nov. 6, 2008

(51) Int. Cl.
*A47C 20/00* (2006.01)

(52) U.S. Cl. ..... 5/640; 5/636; 2/468

(58) Field of Classification Search ..... 5/636, 5/639, 652, 648, 640; 297/393, 411.2; 2/468; 602/18

See application file for complete search history.

(56) References Cited

U.S. PATENT DOCUMENTS

| | | | | |
|---|---|---|---|---|
| 138,463 | A | 4/1873 | Wright | |
| 357,915 | A | 2/1887 | Ferry | |
| 382,949 | A | 5/1888 | Campbell | |
| 2,223,276 | A | 11/1940 | Ward | |
| 4,870,705 | A | 10/1989 | Higby et al. | |
| 4,987,891 | A * | 1/1991 | Gaylord et al. | 602/18 |
| 5,211,623 | A * | 5/1993 | Sarkozi | 602/18 |
| 5,409,450 | A | 4/1995 | Donelson | |
| 5,637,067 | A * | 6/1997 | Ausmus | 482/140 |
| 5,738,640 | A * | 4/1998 | Carlson-Orsi | 602/19 |
| 5,921,903 | A * | 7/1999 | Lawrence | 482/140 |
| 6,135,973 | A | 10/2000 | Zapletal | |
| 6,141,807 | A * | 11/2000 | Tapper | 5/653 |
| 6,202,236 | B1 * | 3/2001 | Price | 5/657 |
| 6,210,303 | B1 * | 4/2001 | Miller et al. | 482/45 |
| 6,308,345 | B1 | 10/2001 | Williams, Jr. | |
| 6,438,805 | B1 * | 8/2002 | Goss et al. | 24/302 |
| 6,449,788 | B1 * | 9/2002 | Nichols | 5/636 |
| 6,503,213 | B2 | 1/2003 | Bonutti | |
| 6,658,681 | B2 * | 12/2003 | Britto et al. | 5/655 |
| 6,859,965 | B1 * | 3/2005 | Gourd | 5/646 |
| 2003/0050582 | A1 | 3/2003 | Poole | |
| 2004/0039316 | A1 * | 2/2004 | Smith | 602/6 |
| 2005/0102758 | A1 | 5/2005 | Ramsbottom et al. | |
| 2005/0283884 | A1 | 12/2005 | Poole | |

OTHER PUBLICATIONS http://benmeadows.com.store.item.139704/.
http://www.lozaenterpizes.com.
http://www.health2work.nl/product.php?cat+12&productid=35.
http://www.lifttrucksstuff.com/safety/liftTruck.htm.

* cited by examiner

*Primary Examiner*—Michael Trettel
*Assistant Examiner*—William Kelleher

(57) ABSTRACT

A head positioning apparatus and method comprises a support member, at least one strap, and a ring. Said support member can be adjustably located proximate to a users head, neck, or other body parts, in order to limit movement of those body parts during activity. Said apparatus and the disclosed methods may comprise additional elements, for example additional straps; means of fastening said straps to an attachment point; one or more cushions slidably affixed to said straps; one or more buckles; and means to adjust tension.

8 Claims, 6 Drawing Sheets

HEAD POSITIONING APPARATUS

DEFINITIONS

"Anatomy" means one or more body parts of a user, for example, either singly or in combination, the head, neck, shoulders, or skin;

"Attachment point" includes any part of an object worn by a user, which the apparatus and method disclosed and claimed herein can be joined to. An "attachment point" would include, for example, a belt loop, button, or top edge of a pair of pants worn by a user;

"Compressible" means capable of changing shape when pressure is applied;

"Compressible material" shall include, for example, articles that contain, in whole or part, either singly or in combination: memory foam, structural foam, urethane foam, polyurethane foam, plastic foam, foam rubber, pillow, porous foam, or non-porous foam;

"Fabric material" means the product formed when natural or synthetic fibers are joined together. Said fibers may be joined together, for example, by weaving, knitting, stitching, or sewing. Said fibers joined together may include for example, cotton, linen, nylon, polyester, or wool;

"For example" and "such as" are illustrative phrases, and are neither limiting nor exclusive;

"Hypoallergenic" means relatively unlikely to induce an allergic reaction in a user;

"Interior" means the space within an object;

"Relatively fixed" means that an object, such as a support member, will remain in substantially the same position and orientation until a force is applied to it;

"Positionally engaged" means that two or more objects are in sufficiently close proximity to permit contact between them;

"Ring" means a rigid band of material, for example, metal, plastic, wood, or rubber, which can be either open, closed, or closable;

"Semi-rigid member" includes materials formed from wire or plastic;

"Slidably affixed" means able to move in at least two directions while remaining in contact with another object;

"Stretchable nylon material" includes elasticized, flexible rubber nylon material;

"Traverse" means to span the distance between two points; and,

"User" means a person who wears the apparatus or practices the method disclosed and claimed herein.

MULTIPLE EMBODIMENTS AND ALTERNATIVES

Figure 1:
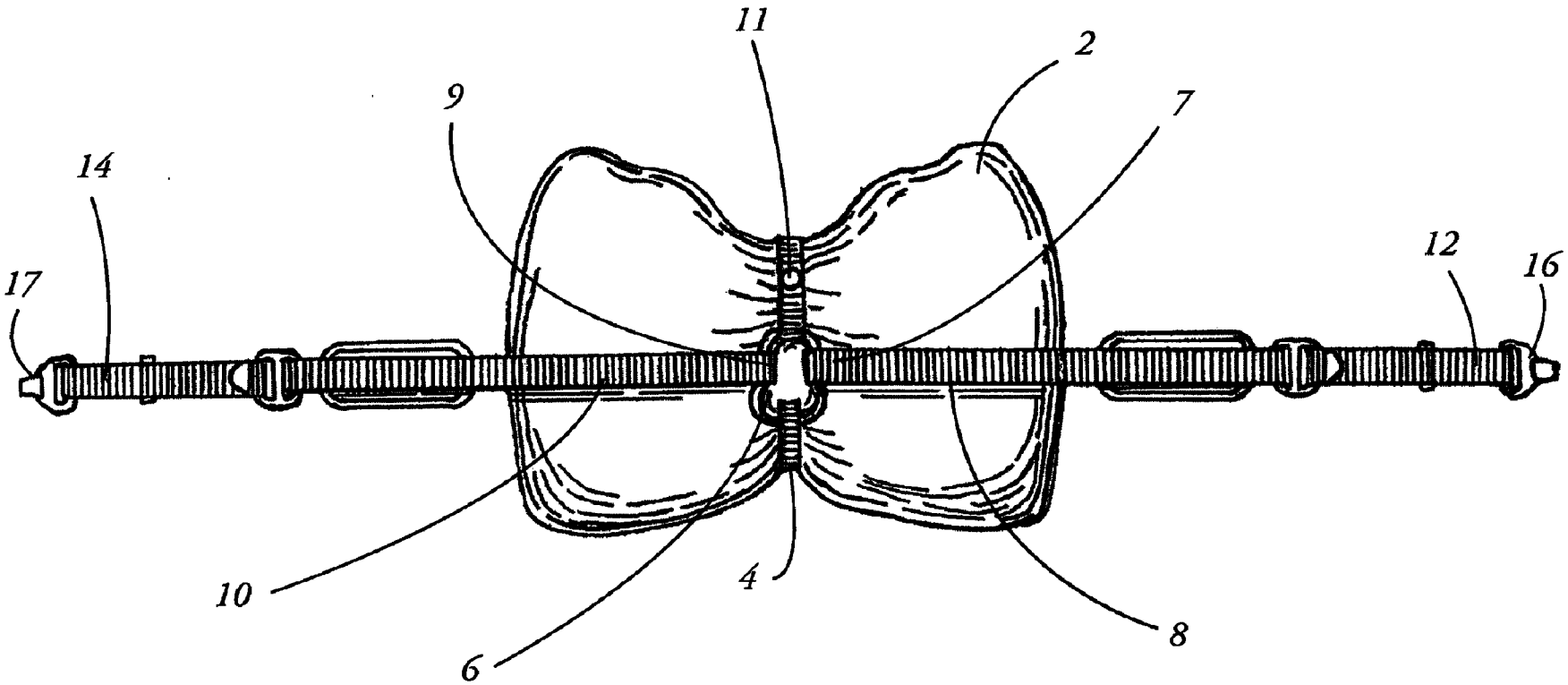
FIG. 1 illustrates a flat plan-view of the apparatus from a rearward perspective.
Figure 2:
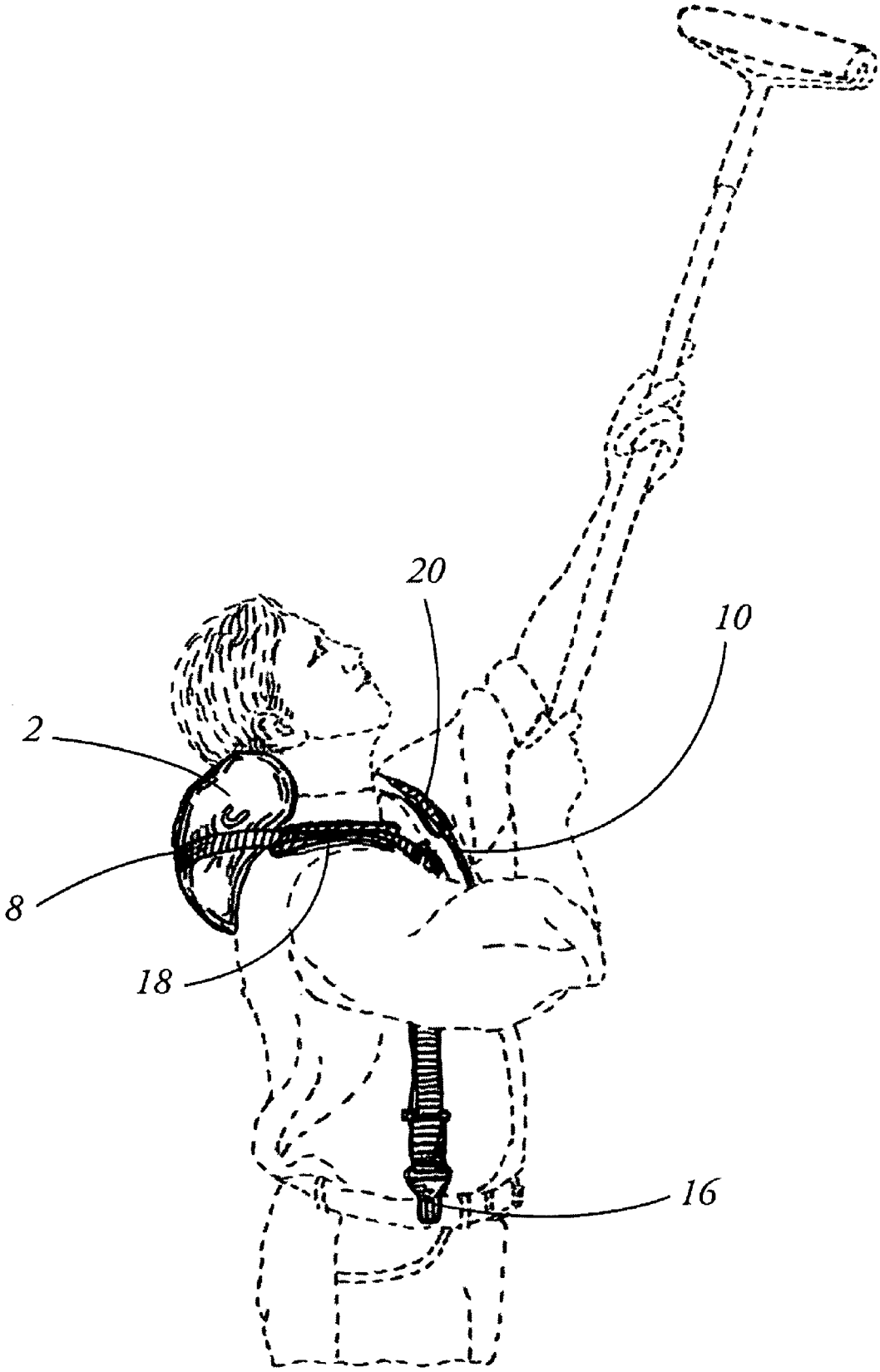
FIG. 2 illustrates a side-view of the apparatus as worn by a user.

FIG. 1 illustrates an embodiment of the apparatus and method disclosed herein, including a support member 2, at least one wrap-around strap 4, and a ring 6. As in FIG. 1, the wrap-around strap has two ends starting at one end of the ring, wrapping around the support member, and attaching to the other end of the ring. In an embodiment, said at least one wrap-around strap 4 is formed from nylon webbing; and both ends of said at least one wrap-around strap 4 is connected around said ring 6. Said apparatus can then be placed proximate to a user's anatomy in order to position the head or neck of a user. For example, a user may perform an activity requiring him to look upward, such as painting a ceiling using a long-handled paint roller as depicted in FIG. 2. The support member 2 of the apparatus and method disclosed herein position a user's anatomy to reduce strain on muscles, tendons, ligaments, and other anatomy of a user.

Figure 3:
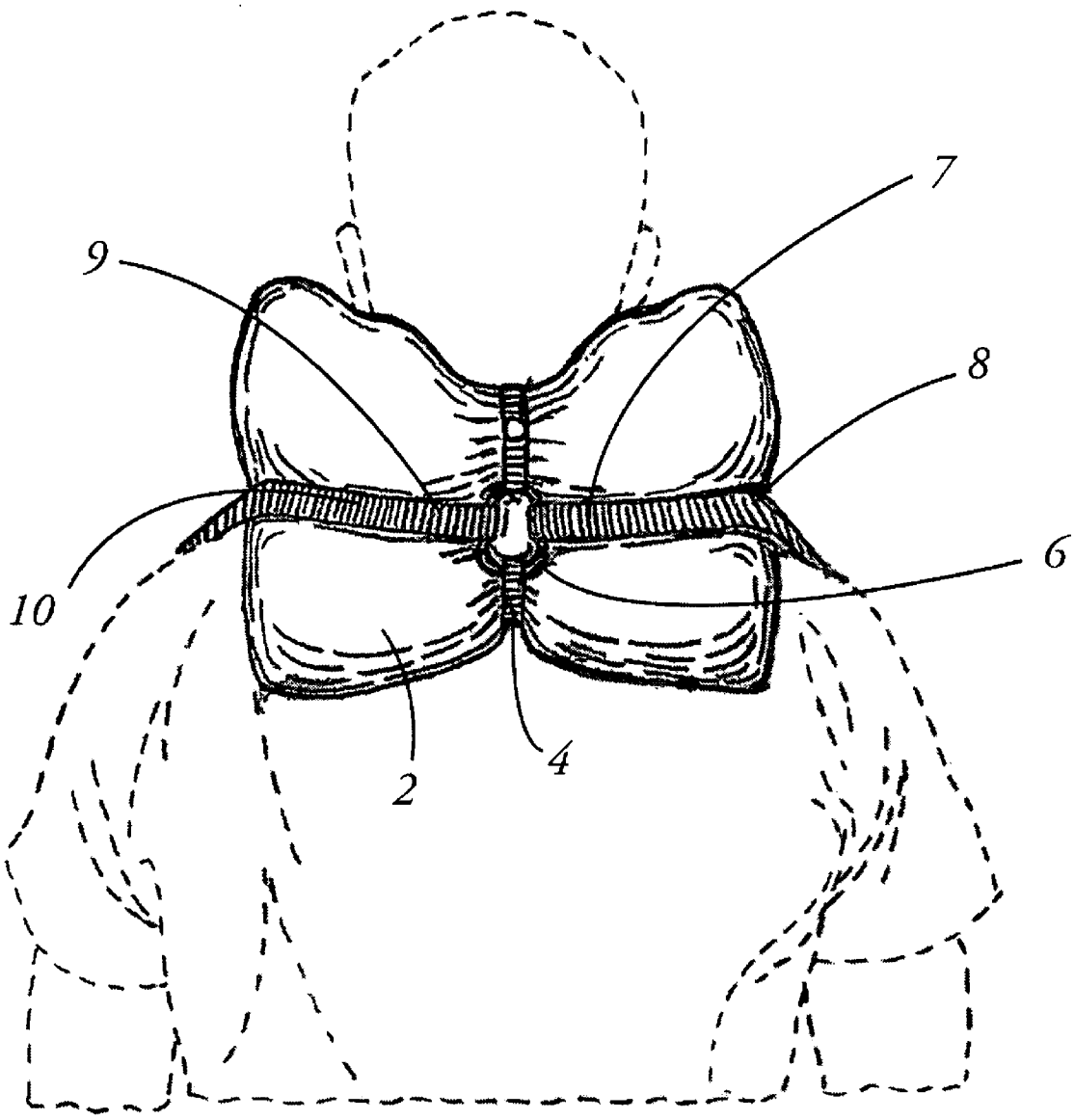
FIG. 3 illustrates a rear-view of the apparatus as worn by a user.

An embodiment as shown in FIG. 3 depicts a rearward perspective of a user wearing the apparatus and practicing the method claimed herein. Said support member 2 is operationally engaged with said first wrap-around strap 4, which is joined to said ring 6. Said first end 7 of said second strap 8 is joined to said ring 6. Said first end 9 of said third strap 10 is joined to said ring 6.

Alternative embodiments of said apparatus and method are disclosed herein. Referring again to FIG. 1, an embodiment has a second strap 8 and a third strap 10. Each of said second strap 8 and said third strap 10 has a first end 7, and 9 respectively, proximal to and connected around said ring 6. A second end 12 of said second strap 8, and a second end 14 of said third strap 10 are distal to said ring 6. In this embodiment, said second end 12 of said second strap 8 has joined to it means to attach 16 said second strap 8 to an attachment point. Said means to attach 16 may be joined to said second strap in a variety of ways, for example by stitching or sewing. In the embodiment described in this paragraph, said means to attach 16 can be, for example, an alligator clip that will attach to a belt worn by a user as shown in FIG. 2, or an alligator clip 17 as is depicted in FIG. 4*a*.

Figure 4B:
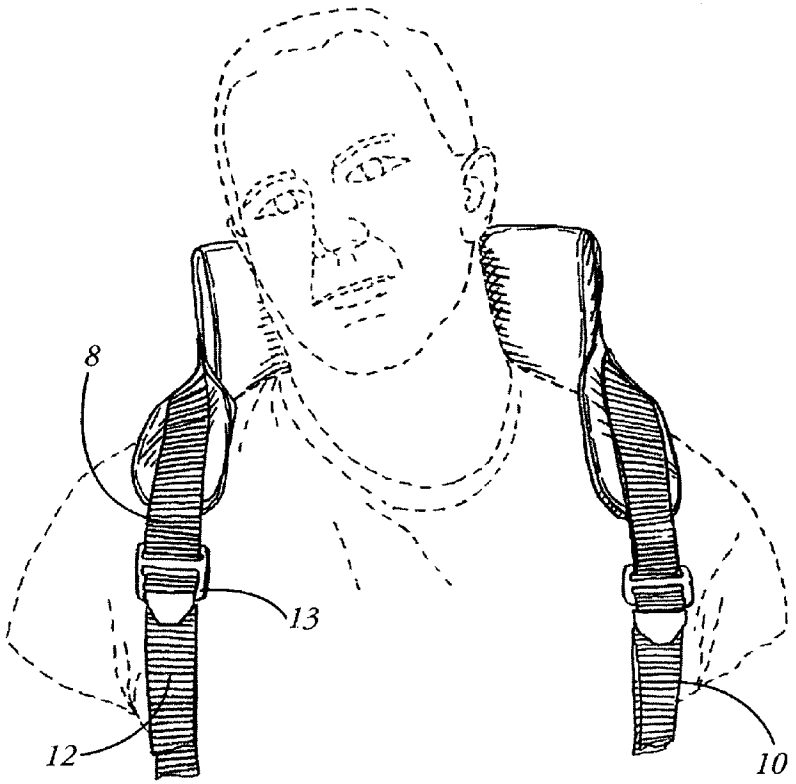
FIG. 4*b* illustrates a front-view of the apparatus as worn by a user.
Figure 4A:
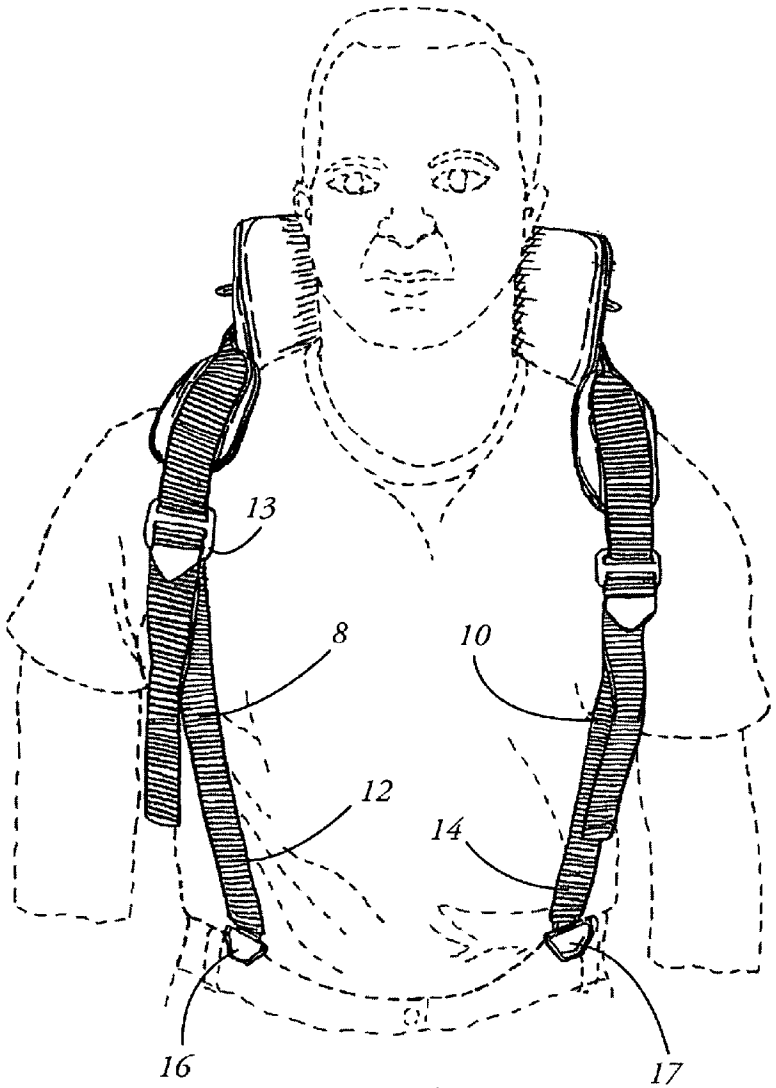
FIG. 4*a* illustrates a front-view of the apparatus as worn by a user.

In an embodiment, for example as illustrated in FIG. 4*a*, a stretchable nylon material having first and second ends can be incorporated into either said second strap 8 or said third strap 10, or both. For example, said first end of said stretchable nylon material can be joined, such as by stitching or sewing, to said second end 12 of said second strap 8. Continuing with this example, said second end of said nylon material can be secured to said means to attach 16.

Referring again to FIG. 2, an embodiment has a first shoulder cushion 18 slidably affixed to said second strap 8. An embodiment may have a second shoulder cushion 20 slidably affixed to said third strap 10 for the same purpose, as shown in FIG. 2.

In an embodiment, for example, as shown in FIG. 3, when said support member 2 is positionally engaged with a user's anatomy, said apparatus and method disclosed herein will restrict movement of a user's head and neck, thereby positioning said user's head. The restriction of movement and positioning of the head specific to a particular user will depend upon various factors such as a user's body size, and dimensions of said apparatus. Certain angles of movement are depicted in FIG. 4*a* compared to FIG. 4*b*, and FIG. 5*a* compared to FIG. 5*b*. These depictions are for illustrative purposes only, and are not intended as limiting. It will be apparent to one skilled in the art that a broad range of positioning can be obtained by using the apparatus and practicing the method disclosed and claimed herein.

In an embodiment, said support member 2 is formed from a compressible material, for example, polyurethane, by cutting to the desired shape using standard industrial cutting methods, for example a band saw. Referring back to FIG. 2, a portion, such as the top portion, of said support member 2 may have a cylindrical shape.

In an embodiment, a fabric material covers said support member 2. Said fabric material may be, for example, a synthetic laminate structure. The selection of fabric material may vary based upon properties desired by a user. An alternative embodiment may use a hypoallergenic covering over said support member 2. Hypoallergenic coverings are commonly available commercially, for example via the interne at http://www.allergybuyersclub.com/.

An embodiment may use moisture wicking fabric material to cover said support member 2. Said moisture wicking fabric material is hydrophobic to repel water from the skin because of water's tendency toward capillary-action, which draws moisture through openings in micro-fibers of said moisture wicking fabric material. Such fabric material may also be employed to regulate a user's temperature. For example, if a user starts to sweat, then said moisture wicking fabric material will draw moisture through the fabric material away from a user's skin, which facilitates evaporation of the moisture and produces a cooling effect.

Referring back to FIG. 3, an embodiment offers means to adjustably locate said support member while said apparatus and method are being worn or practiced. Said means to adjustably locate include, for example, said first strap 8 and said second strap 10. In an embodiment, a top portion of said support member 2 has a curved edge, which is proximate to a user's anatomy, and which enables a user to orient said support member 2 in relation to his anatomy, such as the neck.

Figure 5B:
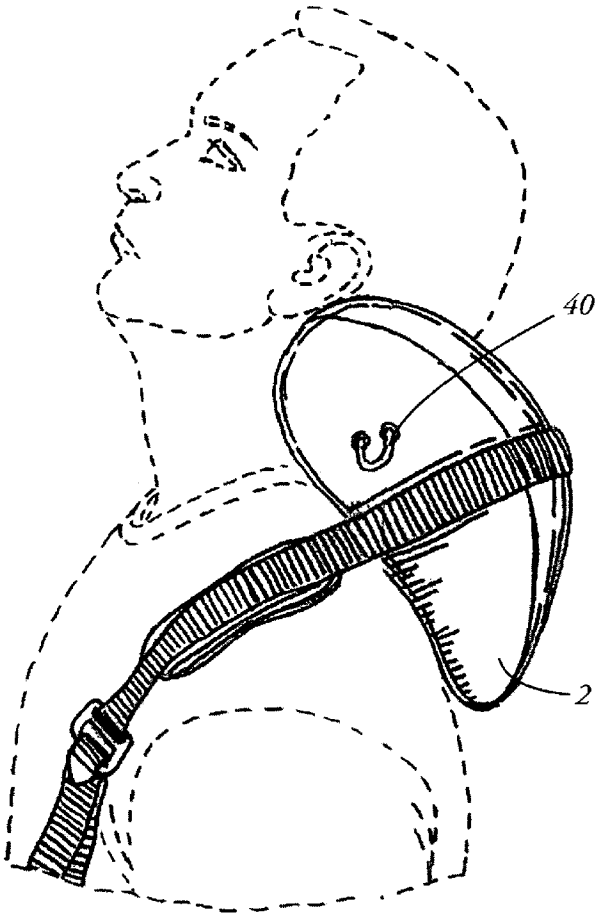
FIG. 5*b* illustrates a side-view of the apparatus as worn by a user.
Figure 5A:
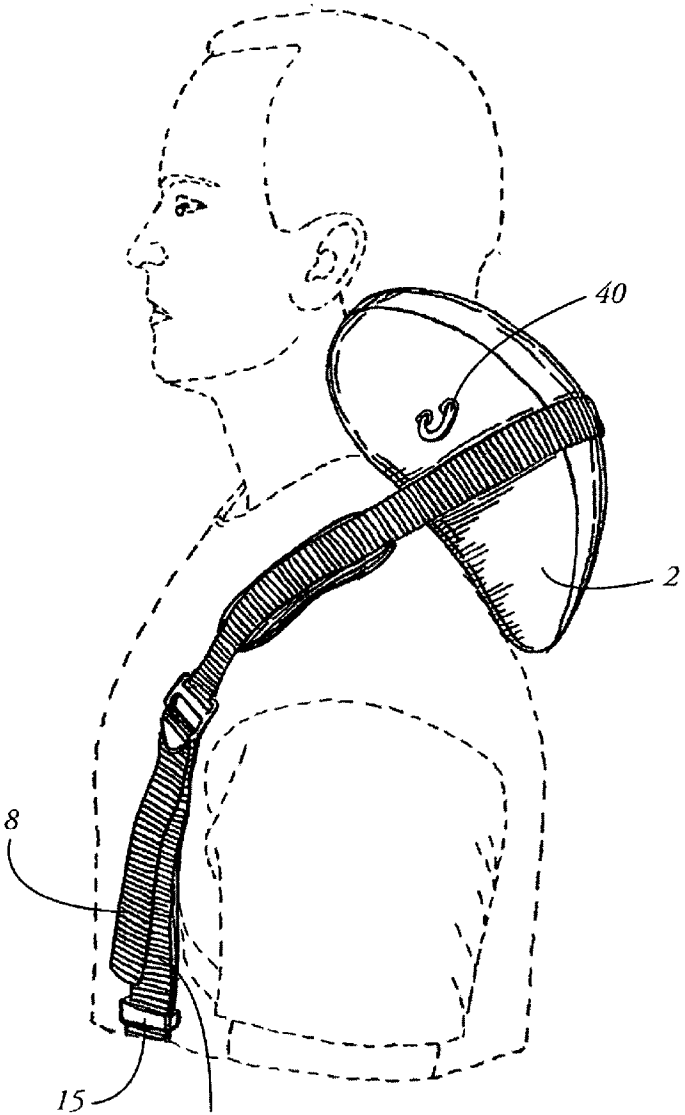
FIG. 5*a* illustrates a side-view of the apparatus as worn by a user.
Figure 6:
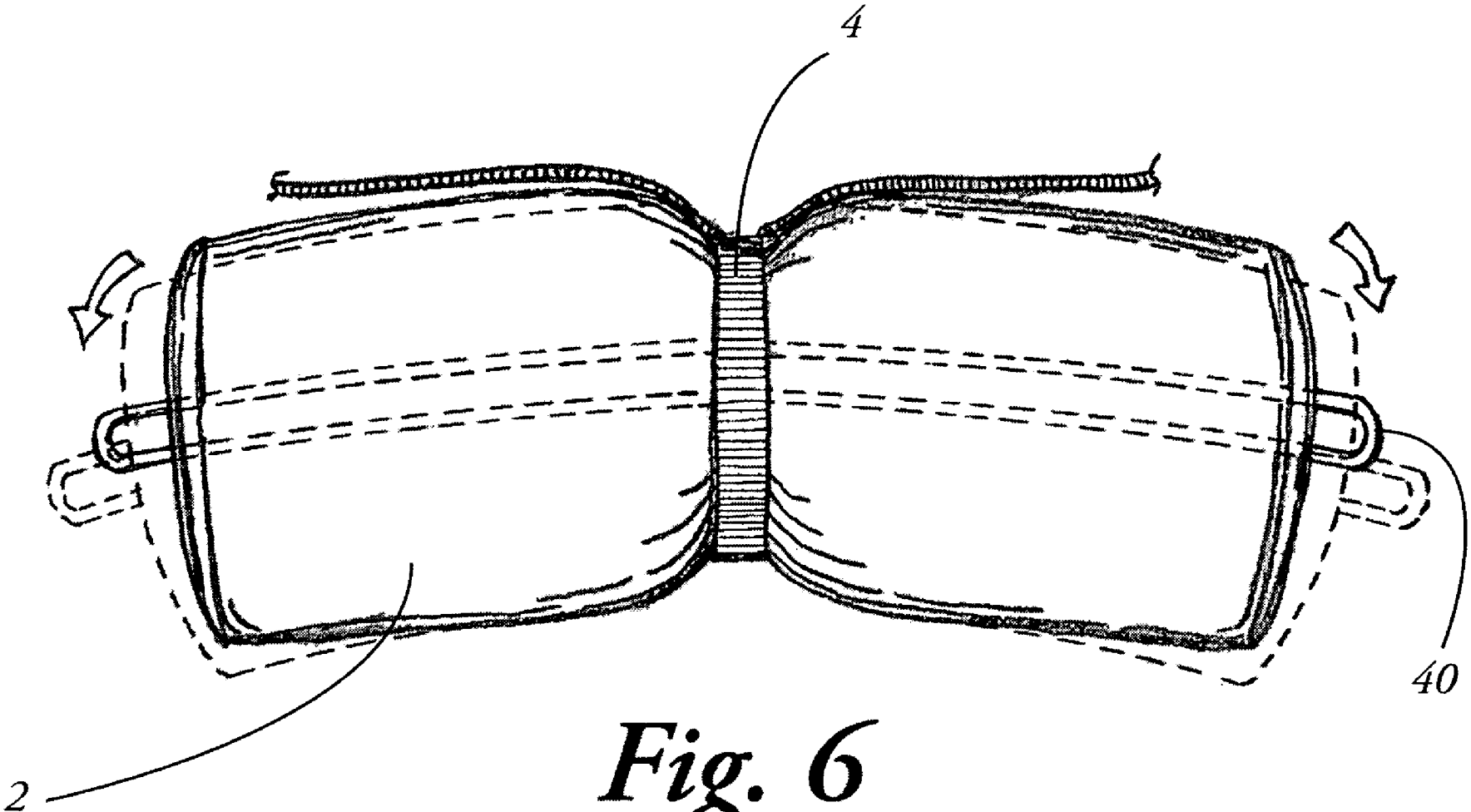
FIG. 6 illustrates a top-view of the apparatus showing an embodiment.

An embodiment as seen in FIG. 5*b* and FIG. 6, respectively, employs a semi-rigid member 40, which traverses said support member 2 through its interior. Said semi-rigid member can be manipulated as depicted by arrows drawn on FIG. 6, in order to selectably orient said support member 2. Said semi-rigid member 40 keeps said support member 2 relatively fixed. In an embodiment, various gauges or types of wire may be employed as said semi-rigid member 40, for example a 10-gauge or 12-gauge wire consisting of multiple insulated conductors. Said semi-rigid member 40 may be formed from wire identified as 10-3UFWG or 12-3UFWG, respectively, which can be purchased from retail hardware stores. Said semi-rigid member 40 may also be formed from other materials, for example plastic.

Referring back to FIG. 3, an embodiment may contain multiple straps, for example three straps including said at least one wrap-around strap 4, said second strap 8, and said third strap 10.

A user may desire to adjust the length or, inversely, the tension of a strap. He may employ various means for doing so. For example, a user can insert a said second end 12 of said second strap 8 through the spaces of a slotted member 13 to then grasp it in place selectably as desired by a user, as illustrated in FIGS. 4*a* and 4*b*, respectively. As the strap is taken up, a user may employ a web keeper 15 to maintain substantially overlapping contact between said second end 12 and said second strap 8, as illustrated in FIG. 5*a*.

A user may employ other means to adjust tension, for example by attaching a button 11 out of a series of buttons over a button receptacle (hidden by said button) located on said at least one wrap-around strap 4 as in FIG. 1. Other means to adjust tension may include a series of grommets in a strap; inserting an end of a strap through a buckle frame of a strap, with a tongue of said buckle frame being inserted into one of said series of grommets.

Alternative embodiments relate to steps for practicing certain methods set forth and claimed herein. The above disclosures relating to said apparatus teach those methods, as well.

Based upon all the forgoing, it will, therefore, be readily understood by those persons skilled in the art that the present embodiments are susceptible of a broad utility and application. While the present embodiments are described in various alternatives, there may be other unforeseeable embodiments, alternatives, and adaptations, as well as variations, modifications and equivalent arrangements that are insubstantial in light of the substance or scope of the present embodiments and alternatives. Accordingly, the foregoing disclosure is not intended or to be construed to limit or otherwise to exclude such other embodiments, alternatives, adaptations, variations, modifications and equivalent arrangements, the present embodiments being limited only by the claims appended hereto and the equivalents thereof.

I claim:

1. An apparatus for positioning the head comprising: a support member, a plurality of straps, a ring, and a semi-rigid member; wherein said support member is formed from a compressible material, has at least one curved edge, and is capable of being positionally engaged with a user's anatomy; wherein said semi-rigid member comprises at least two wires of approximately 10-gauge or greater, each of said at least two wires being substantially parallel to and operationally engaged with another of said at least two wires, said semi-rigid member traverses the interior of said support member and provides means to selectably orient said support member in a relatively fixed though not absolutely fixed orientation in relation to said user's anatomy; wherein said plurality of straps includes a wrap-around strap, said wrap-around strap has a first end connected to a first portion of said ring, wraps around said support member, and has a second end connected to a second portion of said ring; wherein said plurality of straps further includes a first attachment strap and a second attachment strap, said first attachment strap and said second attachment strap each have a first end connected to a portion of said ring, extend away from said ring, and have a second end with attachment means for attaching said second end to a user during use wherein said user's hands need not remain in continuous contact with said attachment straps during use.

2. The apparatus for positioning the head of claim 1, further comprising a shoulder cushion slidably affixed to at least one of said attachment straps.

3. The apparatus for positioning the head of claim 1, further comprising means to adjust the length of at least one of said attachment straps, and further comprising means to adjust tension of any or all of said plurality of straps.

4. The apparatus for positioning the head of claim 1, wherein a portion of said support member is substantially cylindrical.

5. The apparatus for positioning the head of claim 1, further comprising a fabric material wherein said fabric material covers said support member.

6. The apparatus for positioning the head of claim 5, wherein said fabric material is chosen from the group hypoallergenic material, synthetic laminate material, and moisture wicking material.

7. The apparatus for positioning the head of claim 5, wherein said fabric material regulates body temperature.

8. The apparatus for positioning the head of claim 1, wherein said support member is configured to adjustably locate said apparatus between a user's shoulders.

* * * * *